US006638058B1

(12) United States Patent
Mainusch et al.

(10) Patent No.: US 6,638,058 B1
(45) Date of Patent: Oct. 28, 2003

(54) TUBULAR BURNER FOR INDUSTRIAL FURNACES

(75) Inventors: Sebastian Mainusch, Warendorf (DE); Gerhard Kästingschäfer, Wadersloh (DE); Thomas Woestmann, Münster (DE); Andreas Kroner, Schloss-Holte-Stukenbrock (DE); Oliver Wilde, Beckum (DE); Reinhard Körting, Ennigerloh (DE)

(73) Assignee: Krupp Polysius AG, Beckum (DE)

( * ) Notice: Subject to any disclaimer, the term of this patent is extended or adjusted under 35 U.S.C. 154(b) by 0 days.

(21) Appl. No.: 10/009,941

(22) PCT Filed: May 5, 2000

(86) PCT No.: PCT/EP00/04060

§ 371 (c)(1),
(2), (4) Date: Dec. 7, 2001

(87) PCT Pub. No.: WO00/75565

PCT Pub. Date: Dec. 14, 2000

(30) Foreign Application Priority Data

Jun. 7, 1999 (DE) ..... 199 25 875

(51) Int. Cl.[7] ..... F23C 7/00
(52) U.S. Cl. ..... 431/187; 431/10; 126/91 A
(58) Field of Search ..... 126/91 A; 431/10, 431/181, 8, 187

(56) References Cited

U.S. PATENT DOCUMENTS 4,797,087 A * 1/1989 Gitman ..... 431/10
5,788,921 A * 8/1998 Gitman et al. ..... 266/225
5,858,302 A * 1/1999 Gitman et al. ..... 266/182
5,904,895 A * 5/1999 Gitman et al. ..... 266/225

FOREIGN PATENT DOCUMENTS

| | | | |
|---|---|---|---|
| DE | 43 193 63 | 12/1994 | |
| DE | 196 48 981 | 5/1998 | |
| DE | 19925875 A1 * | 12/2000 | ..... F23C/7/00 |
| JP | 2001116212 A * | 4/2001 | ..... F23C/11/00 |
| WO | WO 75565 A1 * | 12/2000 | ..... F23C/7/00 |

OTHER PUBLICATIONS

D. Matovic, E.W. Grandmaison, Z. Miao, and B. Fleck. Mixing patterns in a multiple–jet, ultra–low–NO CGRI burner. In The American Flame Research Committee Spring Meeting, May 2002.*

* cited by examiner

*Primary Examiner*—Henry Bennett
*Assistant Examiner*—James Barrow
(74) *Attorney, Agent, or Firm*—Muramatsu & Associates

(57) ABSTRACT

A tubular burner for industrial furnaces is capable of achieving a good mixing of combustion gas and fuel. This burner contains an end section projecting into a combustion zone supplied with secondary combustion air, and several separate annular feed ducts for combustion gas and fuel bounded by tubular walls arranged coaxially one inside the other, individual nozzles being arranged in approximately annular distribution in the end wall of the combustion gas feed duct facing into the combustion zone. To achieve a good mixing of combustion gas/combustion air and fuel, at least one outer annular feed duct is constructed essentially as fuel feed duct, whilst the combustion gas feed duct equipped with individual nozzles is arranged radially inside this fuel feed duct.

7 Claims, 2 Drawing Sheets

TUBULAR BURNER FOR INDUSTRIAL FURNACES

The invention relates to an industrial furnace having a tubular burner, in accordance with the preamble to claim 1.

A particularly preferred field of application for such an industrial furnace is in installations for the heat treatment of mineral goods, for example, furnaces or furnace systems for the heat treatment or calcining of cement clinker, lime, ores and so on; industrial furnaces and industrial furnace systems that come into consideration are in particular rotary tubular kilns, calcining furnaces and calcining installations etc.

It is exactly with industrial furnaces of the above-mentioned kind that it is important that the process of combustion can be influenced by the configuration and mode of operation of the burner, in order to be able to carry out the industrial processes in such industrial furnaces or furnace systems, for example, to be in with the particular properties of the raw material, the desired quality features of the product to be produced, different types of fuel and so on. Furthermore, at the same time the stipulated emission values of such industrial furnaces, for instance in respect of carbon dioxide and nitrogen oxide, must also be adhered to, wherein it is desirable for the associated burner, and hence also the corresponding furnace, to be operated in an energy-efficient and cost-effective manner. To that end, efforts have been made to develop an optimum flame in the furnace combustion zone by means of the burner, by effecting favourable mixing of the incoming combustion air or the incoming combustion gas with the incoming fuel.

Different burner constructions are therefore already known (e.g. DE-A-43 19 363 and DE-A-196 48 981), in which several coaxially arranged tube walls define several separate feed ducts of approximately annular cross-section for combustion gas or combustion air and fuel. In this connection, at the burner front end of the outer annular feed duct intended for the supply of combustion gas, the end discharging into the combustion zone, there are arranged individual nozzles in approximately annular distribution, which surround a fuel feed duct lying within this combustion gas feed duct and are intended to ensure that the incoming fuel and the combustion gas are mixed in that they are adjustable in respect of their radial and/or tangential discharge direction. Practical operation has shown that the desired good mixing between combustion gas or combustion air and fuel can be achieved only to a very unsatisfactory degree. In this connection, above all the secondary combustion air (secondary air) introduced separately into the combustion zone and flowing towards it in the outer circumferential region of the burner is usually insufficiently incorporated into this mixture of combustion gas/combustion air and fuel.

The prior patent application EP-A-0 974 552 relates to a burner for partial oxidation of hydrogen sulphide for the formation of sulphur vapour. The burner comprises a plurality of tube walls arranged radially spaced with respect to one another and coaxially one inside the other, which bound a plurality of separate feed ducts of approximately annular cross-section for combustion gas and fuel with hydrogen sulphide. The outermost annular feed duct is provided for fuel containing hydrogen sulphide. The discharge region of the burner is arranged in an orifice of the combustion zone, a further annular duct for supply of combustion air being formed by the discharge region of the burner and the orifice of the combustion zone.

The invention is therefore based on the problem of so improving an industrial furnace having a burner in accordance with the preamble to claim 1 that the incorporation of fuel into the combustion gas as a whole or into the combustion air as a whole, and hence the entire process of combustion (ignition, thorough combustion of the fuels, $NO_x$ evolution, flame form and length), can be optimally influenced.

That problem is solved in accordance with the invention by the characterising clause of claim 1.

Advantageous constructions of the invention are specified in the subsidiary claims.

Looking at the cross-section of the inner burner mouthpiece, in the case of the industrial furnace according to the invention having a tubular burner the outermost annular feed duct is in the form essentially of a fuel feed duct, and the combustion gas feed duct equipped with the individual nozzles is arranged radially within this fuel feed duct. If this construction in accordance with the invention is applied, for example, to a use of this burner that is especially representative of actual service, for instance in a rotary tubular kiln, into the combustion zone of which oxygen-rich, pre-warmed secondary combustion air, so-called "secondary air, is supplied directly, for example, from a cooler downstream of the rotary tubular kiln, in which process it flows at least partially along or towards the outer circumferential side of the inner burner end section, whilst further combustion gas, especially so-called "primary air" is fed via the inner ring of individual nozzles and fuel is fed through the outer annular fuel feed duct, it can readily be appreciated that the fuel flowing into the combustion zone is blown positively through the radially inner individual nozzles by means of the primary air into the secondary combustion air flowing in from the outside. This means, therefore, that the primary air (as combustion gas) flowing in. via the individual nozzles blows the fuel flowing in through the at least one outer fuel feed duct at least approximately radially outwards towards the circumference of the burner, and hence into the incoming secondary air there, with the result that a very intensive and rapid mixing . . . [of primary air and fuel into the secondary air flowing in from the outside takes place.] furnaces or calciners, in furnaces for the calcining of lime, for the heat treatment of ores and suchlike.

In respect of their discharge direction, the individual nozzles can be oriented not only parallel, but also at a specific angle to the discharge direction of the fuel feed duct externally surrounding them. In this connection, it is also conceivable for the alignment angle of the individual nozzles to be adjustable. If the individual nozzles are oriented obliquely with respect to the discharge direction of the fuel feed duct surrounding them, it is possible for the primary air (or primary combustion gas) flowing into the combustion zone via the individual nozzles to be blown so that it diverges outwardly to a greater or lesser extent. With a skewed arrangement of the individual nozzles with respect to the fuel feed duct surrounding them, a corresponding swirl can additionally be generated, so that the mixing effect of primary air and fuel with the secondary air, and hence the influencing of the entire process of combustion, can be correspondingly intensified. In accordance with the one structural alternative and based on optimum findings, this orientation of the individual nozzles can therefore be fixed as a basic setting, or, in accordance with the other structural alternative, the individual nozzles can be re-set time and again depending on the particular conditions (either during operation, or during a stoppage).

At this point, it should be pointed out that although the at least one outer fuel feed duct is intended essentially for feed of the appropriate fuels (liquid or gaseous or finegrained or in powder form), it is quite possible for a certain proportion of combustion air (in admixture with the fuels) to be fed in through the fuel feed duct. Similarly, as required, a certain proportion of fuel can be intermixed with the combustion gas fed in via the individual nozzles or with the primary air introduced there.

The invention will be explained in somewhat more detail hereinafter with reference to largely diagrammatic drawings, in which.

Figure 1:
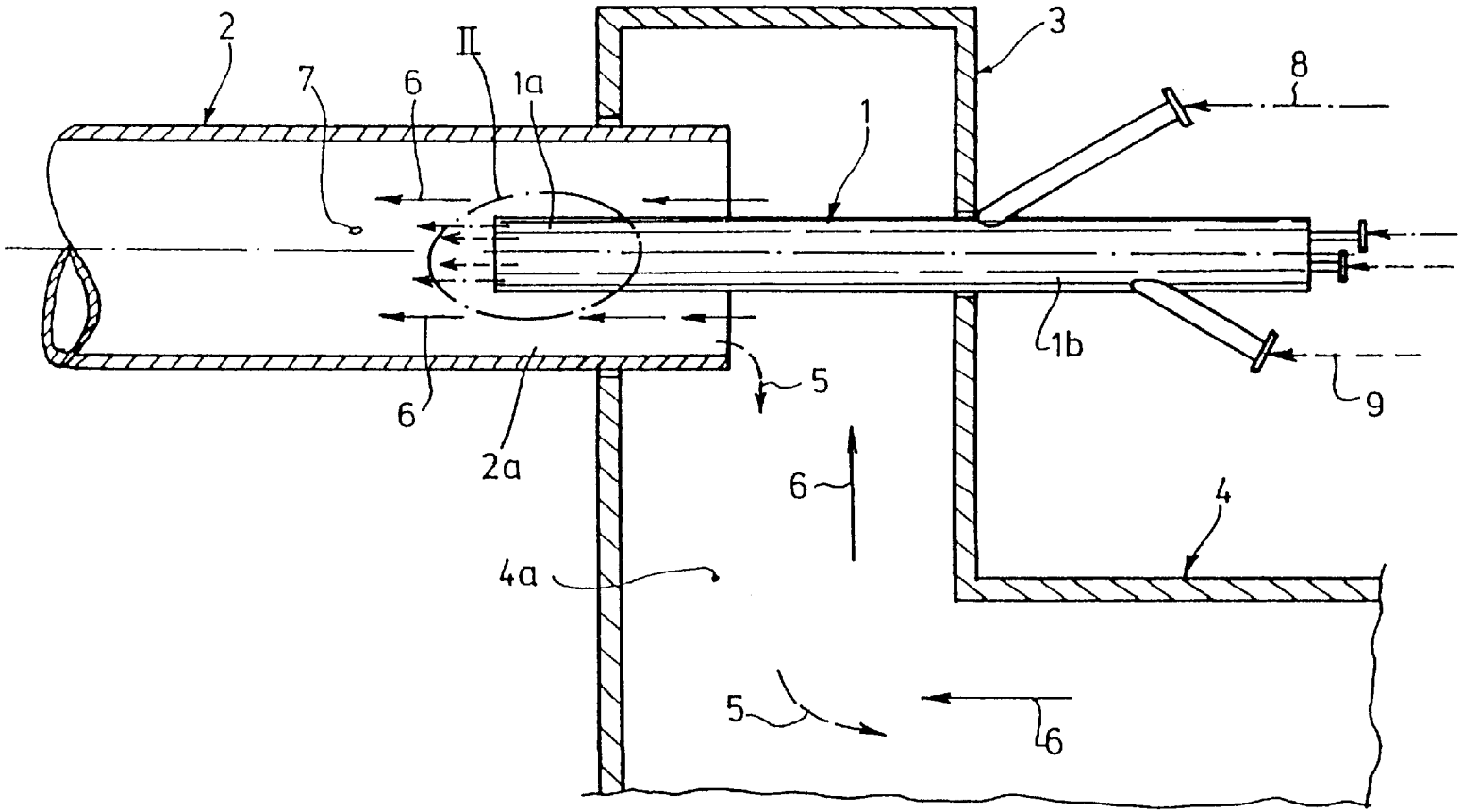
FIG. 1 shows a diagrammatic longitudinal sectional view of an industrial furnace in the form, for example, of a rotary tubular kiln, equipped with a burner according to the invention.

The tubular burner 1 constructed according to the invention will be described below with reference to an especially typical example of application or use, namely, use on or in a rotary tubular kiln 2 for the manufacture of cement clinker. In FIG. 1, only the burner end or discharge end 2*a* of this rotary tubular kiln 2 is illustrated in a very approximate and diagrammatic view, that is to say, this rotary tubular kiln 2 can be constructed in any suitable manner. This discharge end 2*a* of the kiln projects into a customary kiln discharge head 3, by which the kiln end 2*a* is connected with the inlet 4*a* of a cooler 4 of any suitable kind, therefore shown only in outline in FIG. 1. As is generally well known and indicated in FIG. 1 by broken line arrows 5, completely calcined hot cement clinker emerging from the kiln end 2*a* falls into the cooler 4, where it is cooled down by means of cooling gas, especially cooling air. At least part of the exhaust air from the cooler that has been warmed in this way is introduced as secondary combustion air—hereinafter called merely "secondary air" —directly into the combustion zone 7 inside the end 2*a* of the rotary tubular kiln.

With its inner end section or mouthpiece 1*a*, the tubular burner 1 constructed in accordance with the invention projects, as is known per se, from behind and approximately axially into the end 2*a* of the rotary tubular kiln, that is, into the combustion zone 7 thereof.

As indicated diagrammatically in FIG. 1, the burner 1 is supplied in the region of its outer end section 1*b* located outside the rotary tubular kiln 2 with fuel (dot-dash arrows 8) and combustion gas, especially primary air (broken-line arrows 9) via corresponding feed pipes, and optionally additionally with further firing fuels and air for firing in a manner that is known in principle.

The further construction of the burner 1 according to the invention will be explained in detail in particular with reference to FIGS. 2 and 3, and above all in the region of its mouthpiece 1*a*. According to these Figures, the burner 1, or rather its mouthpiece 1*a*, contains several tube walls arranged radially spaced with respect to one another and coaxially one inside the other, namely, an outer tube wall 10, a first inner tube wall 1 lying coaxially and inside this outer tube wall 10 and at least one further second or central tube wall 12 lying coaxially inside this first inner tube wall 11. These tube walls 10, 11, 12 bound a plurality of separate feed ducts of approximately annular cross-section, that is, an outer annular feed duct 13, an inner annular feed duct 14 lying coaxially inside this outer feed duct 13 and at least one further inner feed duct 15, which in this case can be in the form of a feed duct 15 of approximately circular cross-section inside the central tube wall 12, for example, for ignition burners or the like, not illustrated more specifically here as they are known per se. In the front end 14*c*, facing into the combustion zone 7, of the inner feed duct 14 constructed essentially for supply of combustion gas, that is, in the present case for supply of primary air (arrows 9), there is arranged a number of individual nozzles 16, distributed approximately annularly, as indicated in FIG. 3; as will be mentioned again later, these nozzles are retained fixedly or adjustably in an annular end wall 17, which is fixedly mounted on or in the front end 14*c* of the primary air feed duct 14.

Figure 3:
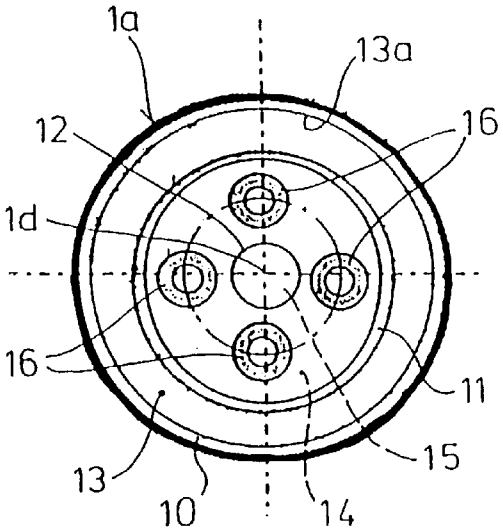
FIG. 3 shows an end view onto the inner burner end (corresponding to arrow III in FIG. 2).
Figure 2:
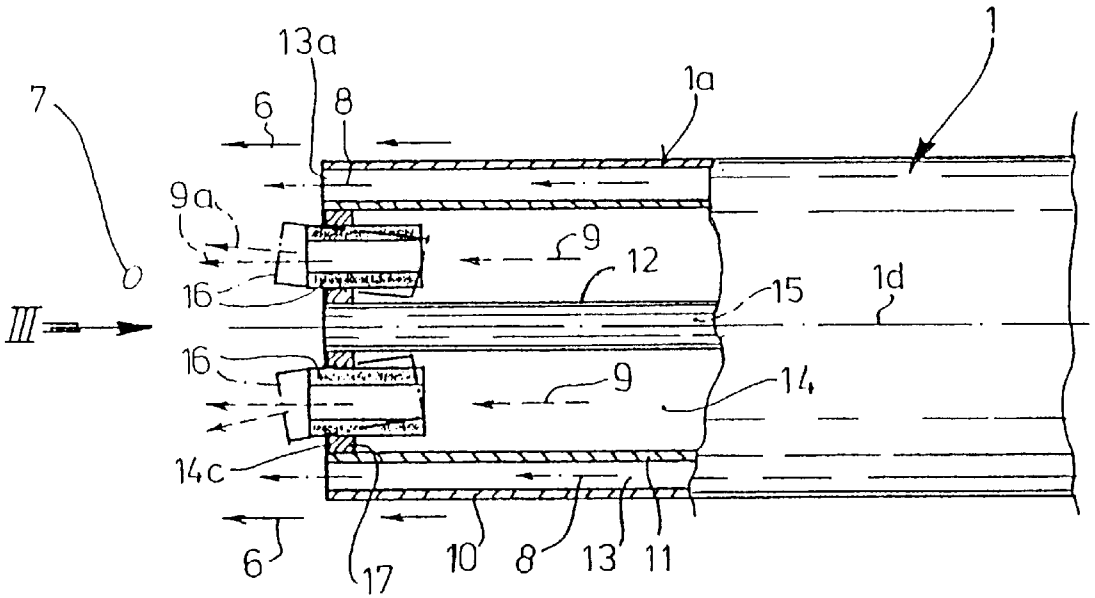
FIG. 2 shows a longitudinal view, partly cut away, of the inner burner end section (approximately corresponding to the fragment II in FIG. 1)

In the case of this burner 1 according to the invention, the outer (or outermost)—looking at the cross-section of the mouthpiece 1*a*—annular feed duct is essentially in the form of a fuel feed duct 13, whilst, as already indicated previously, the combustion gas or primary air feed duct 14 equipped with the individual nozzles 16 is arranged radially inside this fuel feed duct 13 (as shown in FIGS. 2 and 3).

It should also be mentioned at this point that, in modification of the exemplary embodiment described by means of FIGS. 2 and 3, it is also possible in principle to provide a plurality of annular fuel feed ducts and a plurality of combustion gas or primary air feed ducts, without departing from the basic principle of this inventive construction, in which case also the individual nozzles can be provided in a plurality of annularly arranged groups of individual nozzles lying coaxially with respect to one another. It should also be emphasized that any desired or suitable number of individual nozzles 16 can be provided, to tie in with the particular operating conditions, fuels etc.

The illustrations in FIGS. 2 and 3 also show that at its front end facing into the kiln zone 7, the outer fuel feed duct 13 is expediently approximately in the form of an annular nozzle (13*a*) that discharges freely (i.e. openly and substantially unobstructed).

The individual nozzles 16 can be oriented in principle—as is illustrated in FIGS. 2 and 3 by solid lines—with their discharge direction parallel to the longitudinal axis 1*d* of the burner, in order to ensure the improved intermixing effect, described further above, of the fuel into the combustion air, especially into the secondary air. It can also be a particular advantage, however, for the individual nozzles 16 to be oriented as regards their discharge direction (cf. in FIG. 2 broken line arrows 9*a*) obliquely, that is at a specific angle, to the discharge direction (dot-dash arrows 8) of the fuel feed duct 13 surrounding them externally, as is indicated merely partially and very diagrammatically by dot-dash line in FIGS. 2 and 3. This can be effected in a simple way, on the one hand, in that at manufacture of the burner 1 the individual nozzles 16 are fixedly mounted in a suitable basic setting (and so that they are exchangeable if necessary) in the associated end wall 17. On the other hand, however, these individual nozzles 16 can alternatively be adjustably mounted in the associated end wall 17, for example, by means of a universal ball joint, such that their discharge direction can be adjusted obliquely or skewed with respect to the discharge direction of the fuel feed duct surrounding them. In the case of an oblique orientation, only the admission end of the individual nozzles 16, for example, is displaced substantially radially with respect to the burner axis 1*d*. In the case of a skewed orientation of the individual nozzles 16, the admission end of the individual nozzles 16 is moved on a concentric circle about the burner axis 1*d*. These adjustment options of the individual nozzles 16 are not illustrated more specifically in the drawings, since they belong generally to the state of the art, that is, these individual nozzles 16 can be adjustably retained for instance in the manner known, for example, from DE-A-1 96 48 981.

What is claimed is:

1. A tubular burner for industrial furnaces, comprising:

an inner end section projecting into a combustion zone of the furnace supplied with secondary combustion air;

a plurality of tubular walls arranged radially spaced with respect to one another and coaxially one inside the other, which bound a plurality of separate feed ducts of approximately annular cross-section for combustion gas and fuel;

wherein in the front end, facing into the combustion zone, of at least one feed duct constructed essentially for supply of combustion gas, there is arranged a number of individual nozzles distributed approximately annularly; and wherein, viewed in cross-section of the inner burner end section, at least one outer annular feed duct is constructed essentially as fuel feed duct and the combustion gas feed duct equipped with the individual nozzles is arranged radially inside this fuel feed duct.

2. A burner according to claim 1, wherein at its front end facing into the furnace combustion zone, the fuel feed duct is approximately in the form of a freely discharging annular nozzle.

3. A burner according to claim 1, the combustion gas feed duct is provided essentially for the feed of primary combustion air (primary air) and/or selectively for the feed of combustion gas or a primary air-combustion gas mixture.

4. A burner according to claim 1, wherein the individual nozzles arranged in annular distribution are retained in an annular end wall mounted at the front end of the combustion gas feed duct.

5. A burner according to claim 4, wherein the individual nozzles are oriented in respect of their discharge direction parallel to the discharge direction of the fuel feed duct surrounding them externally.

6. A burner according to claim 4, the individual nozzles are oriented in respect of their discharge direction at a specific angle to the discharge direction of the fuel feed duct surrounding them.

7. A burner according to claim 4, wherein the individual nozzles are adjustable in respect of their discharge direction at a specific angle to the discharge direction of the fuel feed duct surrounding them.

* * * * *